United States Patent [19]

Kolb

[11] 3,991,581

[45] Nov. 16, 1976

[54] METHOD AND APPARATUS FOR HANDLING PILING AND ANCHORING AN OFFSHORE TOWER

[75] Inventor: Alfred Reeves Kolb, Corleston on Sea, England

[73] Assignee: Brown & Root, Inc., Houston, Tex.

[22] Filed: June 2, 1975

[21] Appl. No.: 582,677

[52] U.S. Cl. ..... 61/53.5; 61/86

[51] Int. Cl.[2] ..... E02B 17/00

[58] Field of Search ..... 61/46, 46.5, 53.5; 166/.5, .6

[56] References Cited

UNITED STATES PATENTS

| | | | |
|---|---|---|---|
| 3,387,460 | 6/1968 | Morris | 61/53.5 |
| 3,823,564 | 7/1974 | Crout et al. | 61/46.5 |
| 3,826,099 | 7/1974 | Lovie | 61/46.5 |
| 3,895,471 | 7/1975 | Kolb | 61/53.5 X |

*Primary Examiner*—Paul R. Gilliam
*Assistant Examiner*—David H. Corbin

[57] ABSTRACT

A method and apparatus for handling piling and anchoring an offshore tower are disclosed wherein sudden loading of a derrick handling the piling is avoided as the piling is moved into position preparatory to driving. The apparatus entails a base intended to rest upon an upper end of a piling guide. A releasable gripping means is connected to the base and serves to grip and restrain an add-on piling while the add-on piling is connected to a piling connected and thus suspended within the piling guide and also while the suspended piling is released therefrom. Releasing means are employed to release the gripping means to permit concurrent downward movement of the add-on and suspended piling.

In further aspects, the apparatus and method of the invention effect the connection of an add-on piling to a piling suspended from an offshore tower by first at least partially enclosing the add-on piling within a chuck releasably gripping the add-on piling. The add-on and chuck are next hung from the boom of a floating derrick and the add-on piling is connected to the suspended piling. The piling is thereafter disconnected from the piling guide while the suspension thereof is concurrently maintained by a restraining engagement between the chuck and the piling guide. Ultimately the piling is lowered and forced into the strata underlying the floor of the body of water.

10 Claims, 12 Drawing Figures

FIG. 3
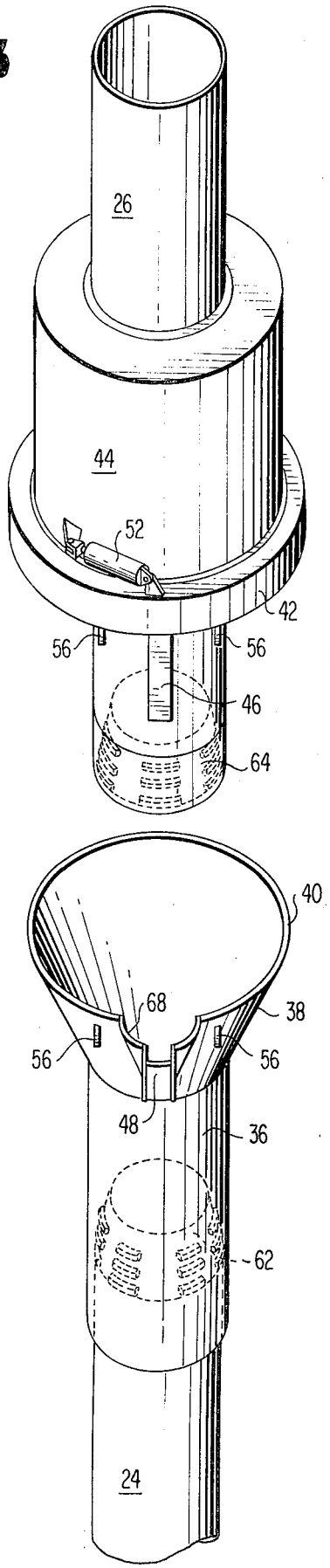
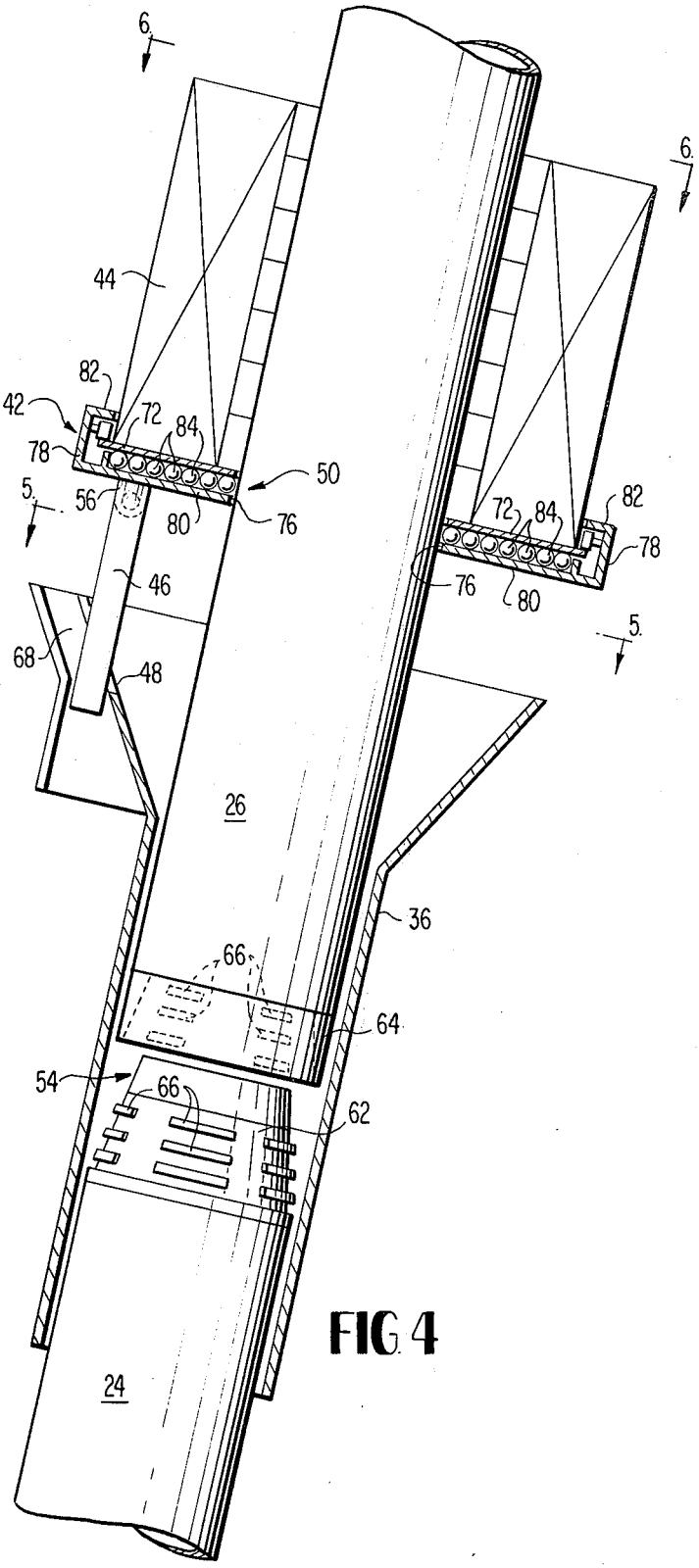
FIG. 4

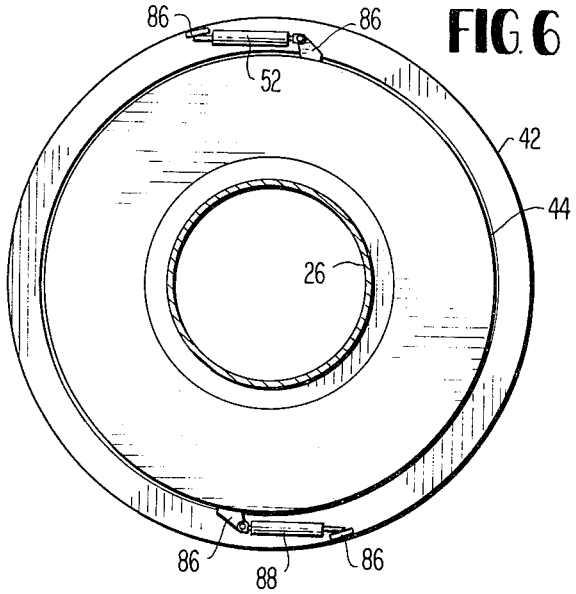
FIG. 6
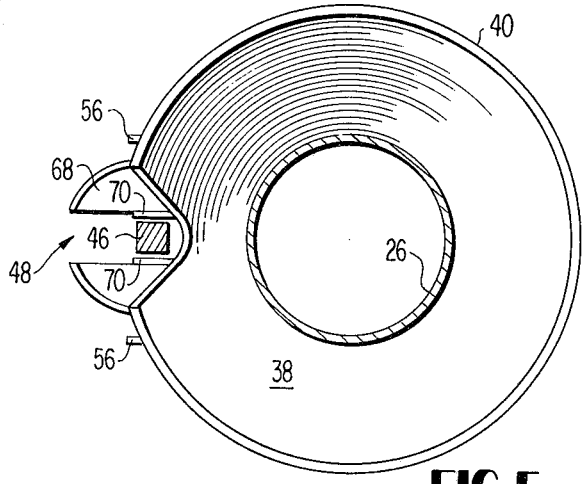
FIG. 5
FIG. 7
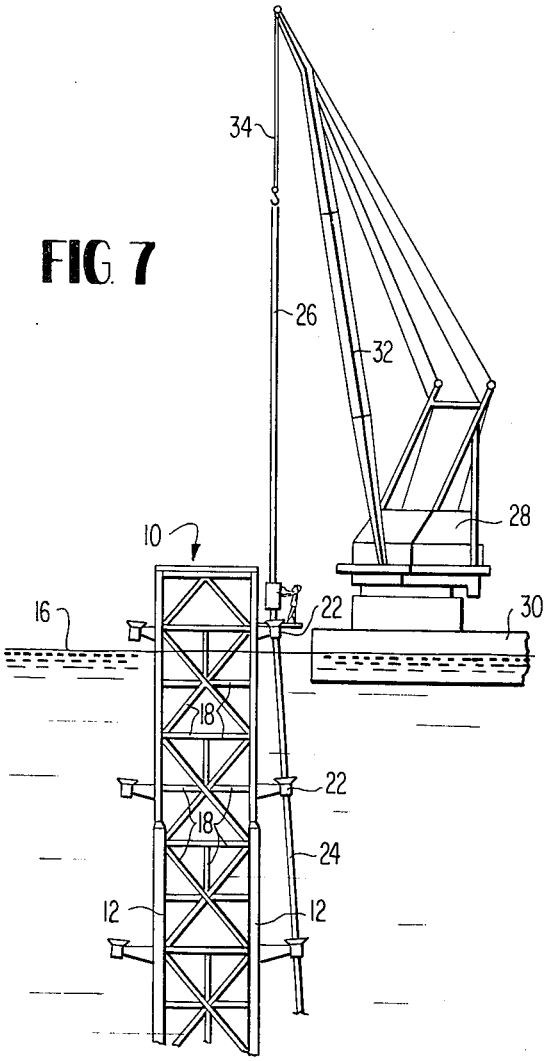
FIG. 7A
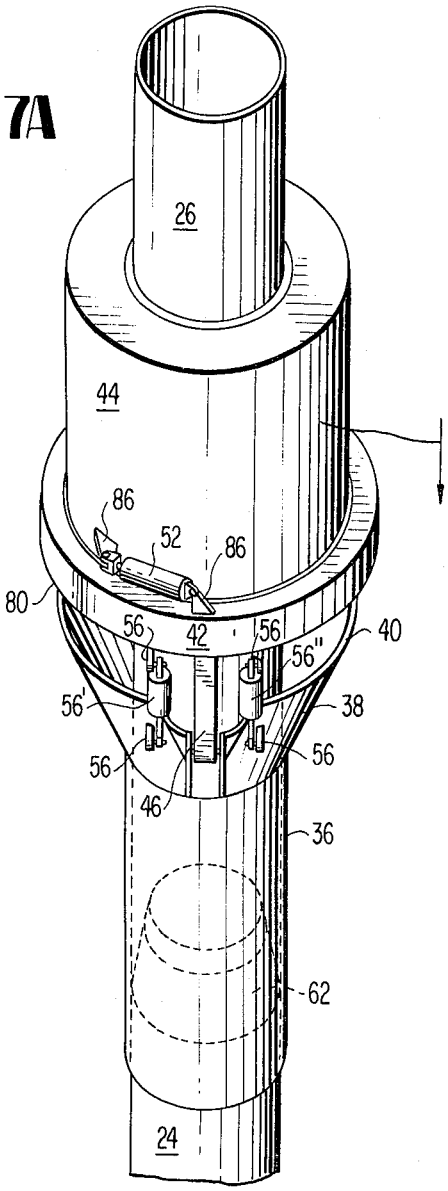

METHOD AND APPARATUS FOR HANDLING PILING AND ANCHORING AN OFFSHORE TOWER

BACKGROUND OF THE INVENTION

The present invention relates generally to a method and apparatus for connecting an initial length of add-on piling to a length of piling suspended from an offshore tower and for thereafter handling the entire piling without imparting undue impact loadings on the derrick employed to manipulate the piling. More particularly, the invention relates to a method and apparatus by means of which the alignment and connection of the add-on piling to the suspended length of piling is automated to a large extent and through which the entire piling can be lowered to the floor of a body of water without imposing the impact loads mentioned.

In recent years a great deal of commercial activity has begun focusing on the oceans. In particular, as supplies of petroleum indigenous to the land masses of major industrial countries have diminished exploration of the geological strata underlying the oceans has intensified. Such exploration is continuing and is being pressed into even deeper areas of the oceans.

Once located, oil fields submerged beneath bodies of water may be exploited. This exploitation is commonly initiated through the use of enormous offshore towers positioned in the oil field. The jackets, i.e. the basic framing portions of these towers, are most commonly constructed in a graving dock in a nearby shoreline and are thereafter floated to the desired location. Once the desired location is reached, the jacket is turned upright and placed on the floor of the body of water. A number of pilings are then forced into the floor of the body of water to anchor the jacket in place and the upper portions of the structure are put in place. Once the tower has been completed, one or more wells can be directionally drilled therefrom. A representative offshore tower which may be employed is disclosed in Crout et al. U.S. Pat. No. 3,823,564 which is assigned to the assignee of the present invention. Because of the useful background present in this reference, the text of this patent is hereby incorporated herein by reference as though set forth at length.

As can be well appreciated from an examination of the Crout et al. patent mentioned in the preceding paragraph, offshore towers used in the exploration for oil are normally characterized by a plurality of long legs interconnected by lattices of bracing members. Pilings employed to anchor the tower to the floor of the body of water can interact with the legs in at least two different ways. The pilings may, for instance, pass downwardly through the legs into the floor of the body of water or alternatively pilings may pass downwardly through piling guides disposed on the exterior of the legs. The piling guides used in connection with the latter approach may take the form of conduits and/or guiding collars. In either of the above cases, the length of piling which is to be initially driven into the floor of the body of water may be secured temporarily in place during the constructions of the jacket. The initial lengths of piling to be driven can thus be carried with the jacket as it is floated to the desired offshore location as essentially an integral part of the jacket. The amounts of piling which must be hauled to the site by a service barge are significantly reduced and thus the logistics of the placement of the tower can be simplified. The lengths of piling normally extend from either the lower end of the jacket or from a short distance thereabove to near the top of the jacket.

The jacket is first floated to the desired site and placed on the floor of the body of water. While the initial lengths of piling to be driven are still temporarily connected to and thus suspended from the jacket, add-on pilings may be lifted into place by means of a derrick floating nearby and may be connected to the suspended length of piling. Once the add-on pilings are connected to the pilings suspended from the tower, the entire assembly can be released from connection with the tower and moved downwardly into contact with, or the short distance through the mud into the submerged surface water. At this point the pilings are normally driven into the floor of the body of water and may ultimately be grouted to solidly anchor the jacket.

Quite significantly, the add-on pilings must be permanently connected to the pilings initially suspended from the tower and must also be properly aligned therewith to ensure smooth and complete penetration of the strata underlying the tower. Structural inadequacies in the connection between the add-on and the suspended lengths of piling, as well as variations in the axial alignment thereof, may precipitate a failure of the pilings and/or may diminish the extent to which the piling can be driven into the floor of the body of water.

It should thus be apparent at this point that once the jacket is placed on the floor of the body of water it should be possible to effectively connect the add-ons to the temporarily suspended lengths of piling, to then release the pilings from the temporary connection with the tower, and to thereafter drive and possibly grout the pilings securely in place. These exacting requirements must be met under grave handicaps. Workmen erecting the tower must contend with a very hostile environment, particularly if the tower is to be placed in such an area as the North Sea. Furthermore, the amounts of equipment available in placing the tower are relatively limited since normally most of the equipment must operate from vessels floating nearby. This equipment, of course, is subject to the hazards of the open sea and due to the turbulent character of the waters may be vulnerable to overstressing. Finally, it must be realized that once the add-on pilings are connected to the suspended pilings, the piling, often extremely heavy, must be released from the structure and safely moved into position preparatory to the forcing of the piling into the underlying strata.

As was mentioned earlier, the pilings suspended temporarily from the offshore tower may extend to the intended base of the tower or to within a relatively short distance thereof. The piling thus does not quite reach solid underlying strata of the floor of the body of water capable of supporting the piling. Thus, once the add-on is connected and the whole piling disconnected from the tower, if the derrick used to manipulate the add-on remains connected to the piling, the derrick may be subjected to severe impact loading as the full piling load is assumed by the derrick. It would therefore be highly desirable if a method and apparatus could be provided in which the floating derrick is largely isolated from impact loads which may occur as an incident to the anchoring of the tower to the floor of the body of water.

It may be necessary in many methods and apparatus of the prior art for the floating derrick to steady and/or align the add-on pilings as each is connected to the piling temporarily suspended from the jacket. While the add-on is being connected to the suspended piling, it may be necessary to maintain the cable extending between the boom of the jacket and the add-on piling in tension. During this portion of the operation, winds and the action of waves may cause movement of the derrick relative to the tower. Sudden movements of this type, particularly if the add-on is in any way restrained by the jacket, can impart severe impact loadngs to the derrick. This may be a particular problem if the waves occurring in the vicinity of the jacket cause the derrick to heave significantly. It will thus be appreciated that it would be quite desirable if a method and apparatus could be provided which would permit the disconnection of the derrick from the add-on during connection of the add-on to the suspended piling and prior to the time at which the suspended piling is disconnected from the jacket. This would avoid impact loadings imposed as an incident to the action of waves in the vicintiy of the jacket.

Certain methods and apparatus of the prior art may require the piling temporarily suspended from the jacket to be disconnected therefrom without any concurrent restraint. This disconnection could precipitate a sudden dropping of the piling to the floor of the body of water. Inasmuch as the piling can be quite heavy, this clearly poses a threat of damage to the jacket and injury to workmen. This problem might be circumvented to some extent by restraining the piling by means of the floating derrick. This, however, would cause either or both of the problems discussed in the preceding paragraphs. It would therefore be very advantageous if a method and apparatus could be provided wherein the piling is restrained as it is being disconnected from the jacket and wherein the piling can be safety lowered without imposing severe impact loadings on the floating derrick.

Proper connection of the pilings together may require a particular rotational relation between the add-on piling and the suspended length of piling. It would therefore be highly desirable if a method and apparatus could be provided which would afford an accurate, safe, and rapid as well as essentially automated alignment of the add-on piling relative to the suspended length of piling without the need of cumbersome external fixtures or other structure integral with the jacket.

Commonly, in methods and apparatus of the prior art, the add-on pilings are lifted to atop the suspended piling preparatory to undergoing connection therewith. Once the add-ons are so placed, workmen must contend with a long, slender length of very heavy material poised atop the tower, fully exposed to a hostile environment and perhaps subject to movements of the floating derrick. It would therefore be very advantageous if a method and apparatus could be provided which would rigidly, but adjustably, connect and stabilize an add-on piling atop a suspended length of piling preparatory to and during actual connection therebetween.

OBJECTS AND SUMMARY OF THE PREFERRED FORMS OF THE INVENTION

In light of the foregoing it is a general object of the invention to provide a novel method and apparatus intended to obviate or minimize problems of the type noted.

It is a particular object of the invention to provide a novel method and unitary apparatus by means of which an initial add-on piling may be connected to a length of piling temporarily suspended from an offshore tower jacket and which may be thereafter employed to handle the piling independently of the jacket or any associated floating derrick.

It is another object of the invention to provide a method and unitary apparatus through which a floating derrick used to manipulate the piling can be isolated from impact loadings which might be developed incident to the anchoring of an offshore tower jacket to the floor of a body of water.

It is still another object of the invention to provide a novel method and unitary apparatus which allows the substantial disconnection of the floating derrick from the piling of an offshore tower prior to the time the piling is disconnected from the associated jacket and which thereby avoids impact loading on the floating derrick due to wave action in the vicinity of the jacket.

It is yet still another object of the invention to provide a method and unitary apparatus capable of restraining the piling once the piling is disconnected from the associated jacket so that the floating derrick can be essentially reconnected thereto for the purpose of lowering the piling to the floor of the body of water gradually and without impact loading of the derrick.

It is a further object of the invention to provide a novel method and unitary apparatus which automates the accurate alignment of an add-on piling with a length of piling temporarily suspended from the offshore tower jacket.

It is still a further object of the invention to provide a method and unitary apparatus which automates the axial alignment of the add-on piling relative to the length of piling suspended from the jacket.

It is yet still a further object of the invention to provide a novel method and apparatus which automates the accurate rotational alignment of an add-on piling relative to the length of piling suspended from the offshore tower jacket.

It is another object of the invention to provide a method and unitary apparatus which automates the connection of the add-on piling to the length of piling suspended from the offshore tower jacket.

It is still another object of the invention to provide a novel method and unitary apparatus which automates a rotary connection between the add-on piling and the length of piling suspended from the offshore tower jacket.

It is yet still another object of the invention to provide a novel method and unitary apparatus which rigidly but adjustably connects the add-on piling to the length of piling suspended from the jacket preparatory to and during actual connection.

An offshore tower commonly includes a length of piling which is to be forced into the floor of a body of water to anchor the tower thereto. The piling is supported and guided as it is forced into the floor of the body of water by suitable pile guiding means such as conduits and/or pile guiding collars. The pile guiding means often at least partially enclose the length of piling. Commonly, a length of piling may be temporarily connected to the pile guiding means and thus may be suspended above or closely adjacent the soft mud of the floor of the body of water when the jacket is turned upright. An add-on piling is normally connected to the suspended piling once the jacket is properly positioned to afford the added length necessary to begin driving the piling.

A novel apparatus of this invention intended to obviate or minimize problems of the type noted earlier is preferably of a unitary construction independent of the tower and any floating derrick associated therewith. The tool includes a base which is intended to rest upon an upper end of the pile guiding means. Connected to the base is a releasable gripping means such as a jack or chuck which grips and restrains the add-on piling relative to the pile guiding means while the add-on piling is being connected to the suspended piling, and while the suspended piling is being disconnected from the pile guiding means. Suitable releasing means such as an hydraulic control system is operably associated with the gripping means and permits the gripping means to be released after the suspended piling has been disconnected from the pile guiding means. Once the suspended piling has been disconnected from the pile guiding means, the releasing means further permits the movement of the piling from the formerly suspended position above or adjacent the soft mud of the floor of the body of water to a position in contact with underlying strata of the floor capable of supporting the piling.

A novel method of an apparatus of this invention for handling piling an anchoring an offshore tower to the floor of a body of water in which the piling is temporarily connected to and suspended at least partially within a piling guide entails a number of manipulative steps. The add-on piling is first partially enclosed within a suitable gripper such as a jack or a chuck which releasably grips the piling. The add-on piling is next connected to the piling suspended from the jacket. The suspended piling is thereafter disconnected from the piling guide while the suspension thereof is concurrently maintained by a restraining engagement between the gripper and the jacket. The pile is thereafter lowered into position and forced into the underlying strata of the floor to anchor the jacket in place.

THE DRAWINGS

Other objects and advantages of the present invention will become apparent with reference to the detailed description to follow of a preferred embodiment thereof wherein like reference numerals have been applied to like elements and in which:

FIG. 3 illustrates an exploded perspective view of a length of piling suspended within a piling guide and an add-on piling about to be inserted into the guide for connection with the suspended piling;

FIG. 4 illustrates a transverse, partially sectional view of a length of piling suspended within a piling guide and an add-on piling as it is being rotationally aligned with the suspended piling immediately prior to connection therewith (viewing the apparatus from the "back" of FIG. 2);

FIG. 5 illustrates a transverse sectional view taken along the lines 5—5 of FIG. 4;

FIG. 6 illustrates a transverse sectional view taken along the lines 6—6 of FIG. 4;

FIG. 7 illustrates schematically a side view of the offshore tower, pilings, and the floating crane with the add-on piling rotationally aligned with the suspended piling and in contact therewith;

FIG. 7A illustrates an enlarged perspective of an add-on piling, a length of piling suspended within a piling guide, and the rotational alignment and contact therebetween occurring during the stage of operations illustrated schematically in FIG. 7;

Figure 9:
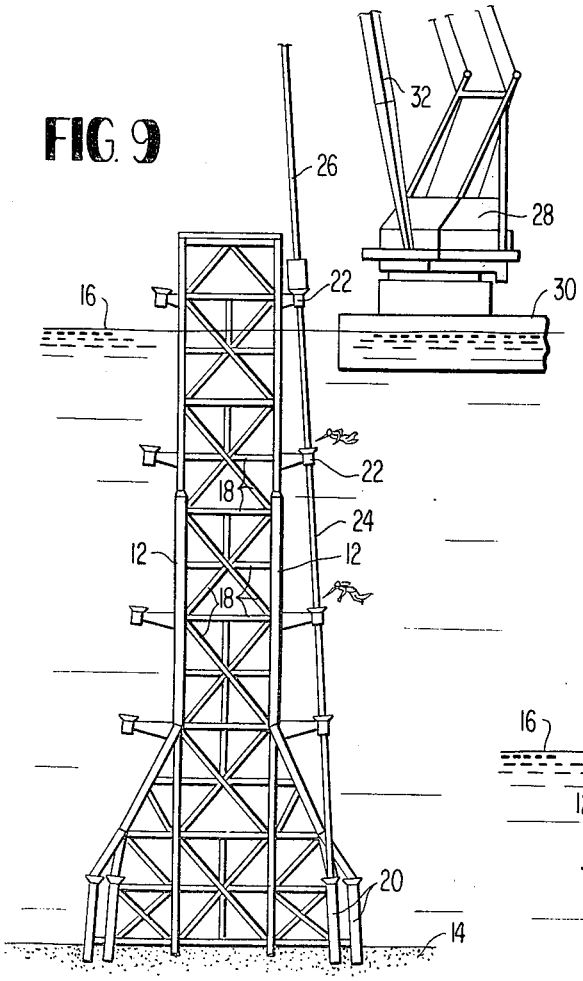
Figure 10:
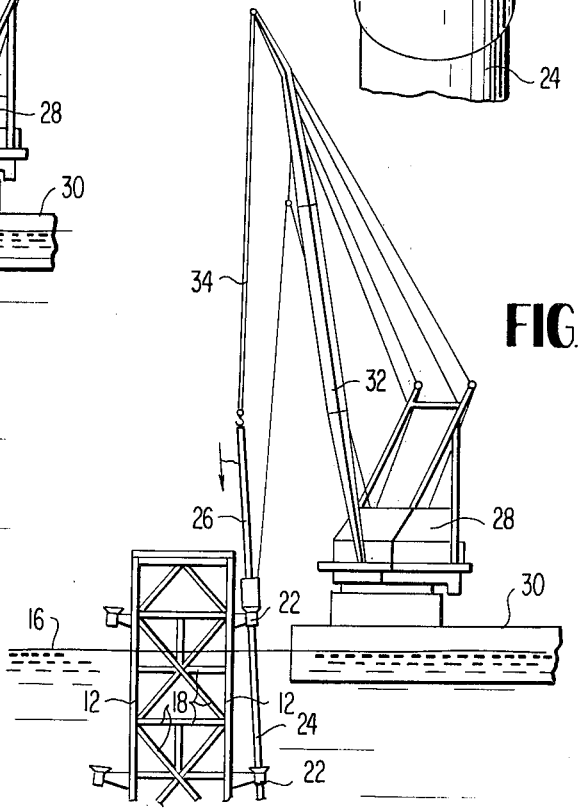

FIG. 9 illustrates schematically a side view of the offshore tower, pilings, and floating crane with the add-on piling rotationally and axially aligned with the length of piling suspended within the piling guides at the stage of operations at which the piling is about to be disconnected from the offshore tower; and FIG. 10 illustrates schematically a side view of the offshore tower, pilings, and the floating crane showing the floating crane supporting the connected add-on and suspended piling and in the process of lowering the entire piling to the floor of the body of water.

DETAILED DESCRIPTION

Brief Overview

Figure 1:
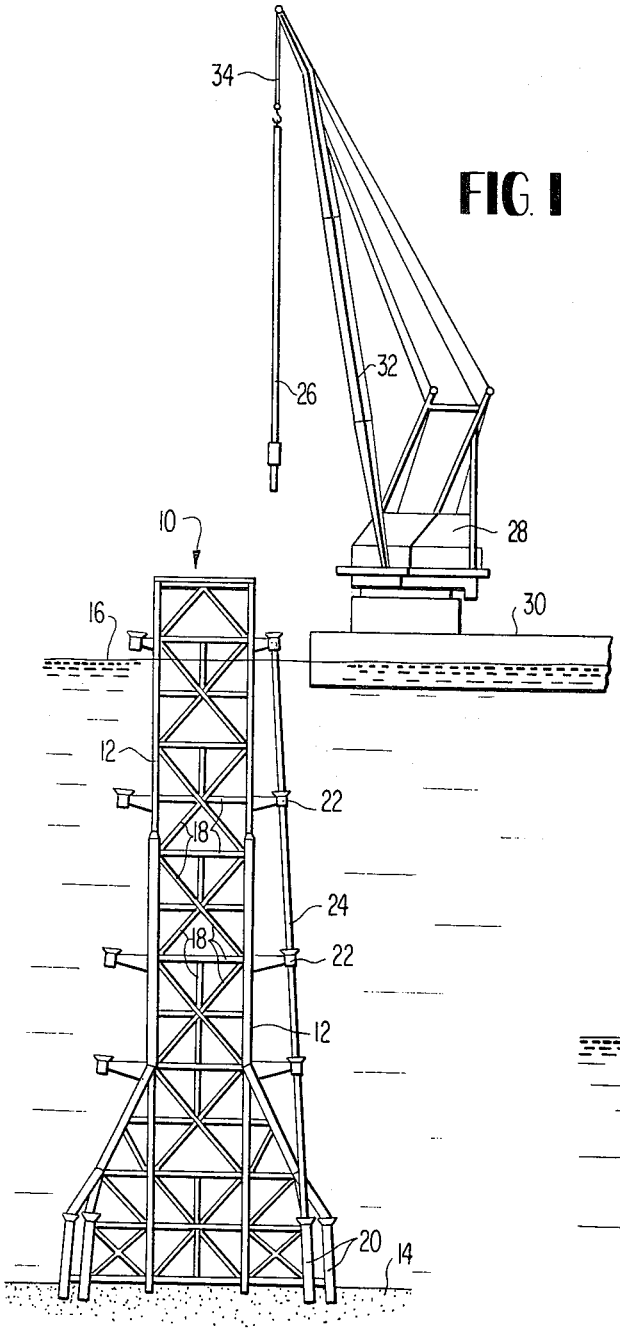
FIG. 1 illustrates schematically a side view of an offshore tower jacket in an upright condition, a length of piling temporarily suspended within piling guides, and an add-on piling suspended from a floating barge and about to be connected to the suspended piling.
Figure 2:
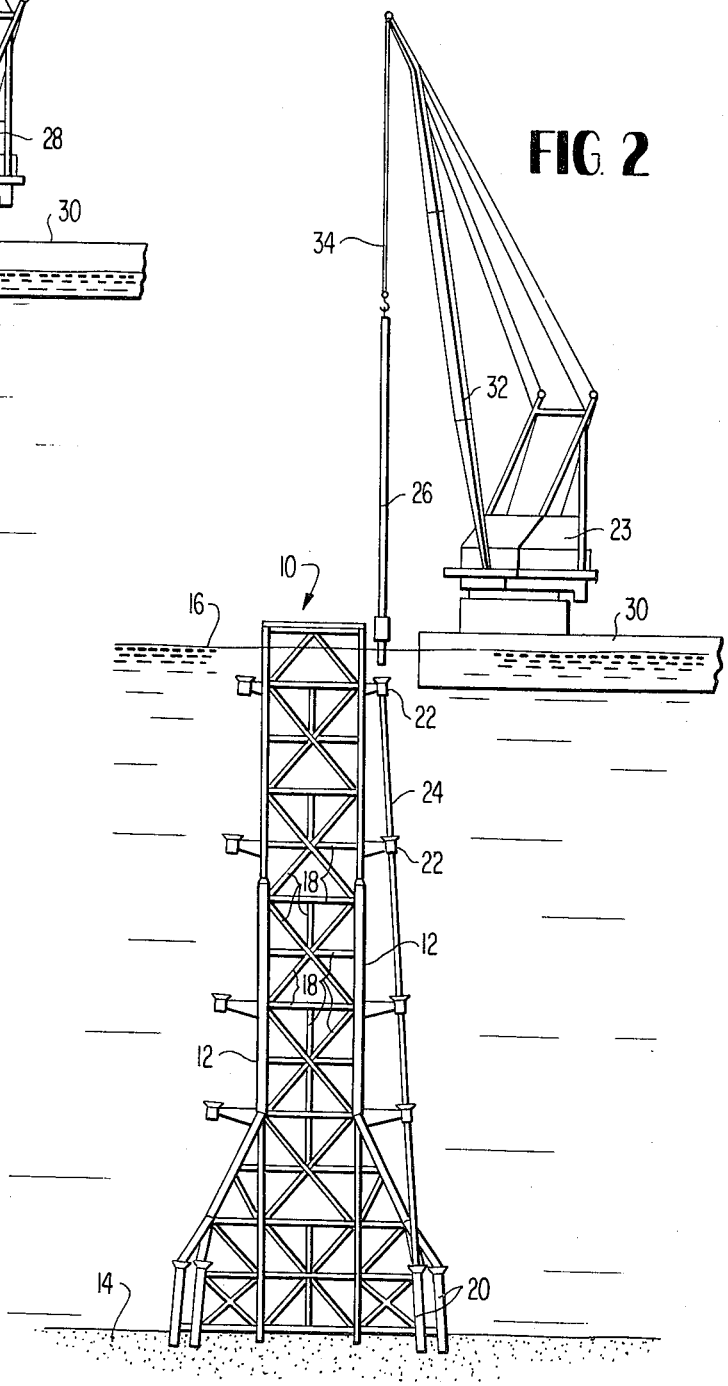
FIG. 2 illustrates schematically a side view of an offshore tower in an upright condition, a length of piling suspended within piling guides, and an add-on piling suspended from a floating crane and about to be connected to the suspended piling in a submerged environment.

A jacket 10 in connection with which the method and apparatus of the present invention may be employed is perhaps best illustrated in FIGS. 1 and 2. It can be appreciated from these figures that the jacket is fabricated from a plurality of legs 12 which normally extend from the floor 14 of the body of water of water to a position above the surface 16 thereof. The legs are interconnected and braced relative to one another by structural lattices formed of braces 18. Operably associated with each such tower are piling guides. These piling guides may be disposed within the interior of the legs 12 or may take the form of individual guide conduits 20 and pile guiding collars 22 as illustrated in the drawings.

To reduce the problems of logistics, the initial lengths of piling to be driven into the floor of the body of water may be temporarily connected within the piling guides, whether the piling guides are within the legs or disposed on the exterior thereof as illustrated. For simplicity, only one such initial length of piling 24 is illustrated in any of the figures. It can be appreciated from FIGS. 1 and 2 that the initial piling 24 extends essentially along the entire length of the legs 12 of the jacket 10. The piling may terminate some distance above the intended lower end of the tower and thus some distance above the floor 14 of the body of water once the jacket has been erected. Alternatively, the piling may extend essentially to the intended lower end of the tower so that the end thereof to some extent may contact the soft mud of the floor of the body of water. In either case, because the piling 24 is temporarily connected within the piling guides and does not extend into contact with strata capable of supporting the piling, the piling is in what might be regarded as a suspended condition.

A length of add-on piling 26 is intended to be connected to the upper end of the suspending piling 24. The length of piling is manipulated by a derrick 28 which is based upon a barge 30 as illustrated in FIGS. 1 and 2. The floating derrick includes a boom 32 and a plurality of sheave-rigged hosting cables 34 which may be employed to manipulate the add-on piling 26 and also other equipment associated with various phases of the construction of the tower.

The unitary tool of the invention is perhaps best illustrated in FIGS. 3 and 4. In each of the FIGURES a piling guide 36 comprised of leg of the tower jacket can be seen. Within the piling guide 36 is suspended the length of piling 24, perhaps best illustrated in FIGS. 1 and 2. The piling guide includes a flared mouth or funnel 38 having a rim 40 which defines a plane.

The tool itself includes a base 42 intended to rest upon the rim 40 of the funnel 38 of the piling guide 36. The tool further includes a suitable releasable gripping means, such as a chuck or jack, which is employed to grip and restrain the add-on piling 26 while the add-on is connected to the suspended piling 24 and while the suspending piling is being disconnected from the piling guide 36. For convenience, the gripping means will be generically referred to hereinafter as a gripper and may comprise any of several well known, remotely operable, gripping or chucking units of the type used in heavy industrial operations, i.e. hydraulically operated clamps used on jack-up rigs to control jack-up leg positioning.

The tool includes axial aligning means for axially aligning the add-on piling 26 with the suspended piling 24. This aligning means is constituted by the combined gripper and base as the base rests firmly on the rim 40 of the funnel 38. Axial alignment is also facilitated by the telescoping relation between the add-on piling and the uppermost piling guide. The particular manner in which the axial alignment is accomplished will be more fully described in the course of subsequent discussions.

The tool also includes rotational aligning means for rotationally aligning the add-on piling 26 relative to the suspended piling 24. This rotational aligning means takes the form of an elongated tongue 46 and a relatively narrow slot 48. The interaction of the tongue and slot may also assist in resisting torque applied to the add-on piling a will be described more fully hereinafter. The particular manner in which the add-on piling is rotationally aligned with the suspended piling will also be described in more detail in the course of subsequent discussions. In any case, when the particular manner in which the add-on piling is axially and rotationally aligned with the suspended piling is more fully described, it will become apparent that the method and apparatus of the invention essentially automates the alignment of the add-on piling relative to the suspended length of piling.

The length of add-on piling 26 must be connected to the suspended length of piling 24. To accomplish this the apparatus of the invention includes connecting means for facilitating the connecting together these two lengths of pilling by rotation. The connecting means is comprises of a swivel connection located generally at 50 and provided between the base 42 and the gripper 44 to permit relative rotation betwee these two elements. As perhaps best illustrated in FIG. 3, the base 42 and gripper 44 are interconnected by an hydraulic cylinder 52 which serves to effect relative rotation between the base and the gripper to connect the add-on and suspended piling together using a rotary connection 54 shown in FIG. 4. This rotary joint may employ any one of several suitable connections such as those commonly termed "breech-block" or Rockwell connectors.

It can be appreciated from the FIGURES that once the add-on piling 26 is moved into abutment with the suspended piling 24, it is posied in a projecting manner atop this length of piling. To assist in stabilizing and manipulating the add-on piling atop the suspended piling, the tool may include suitable stabilizing and manipulating means to aid in interconnecting the two lengths of piling. As perhaps best illustrated in FIG. 7A, the stabilizing means may take the form of padeyes 56, disposed on the base 42 of the tool and the funnel 38 of the piling guide, and interconnected by hydraulic piston and cylinder or "jack" arrangements 56' and 56'' as (illustrated in phantom in FIG. 7A).

Figure 8:
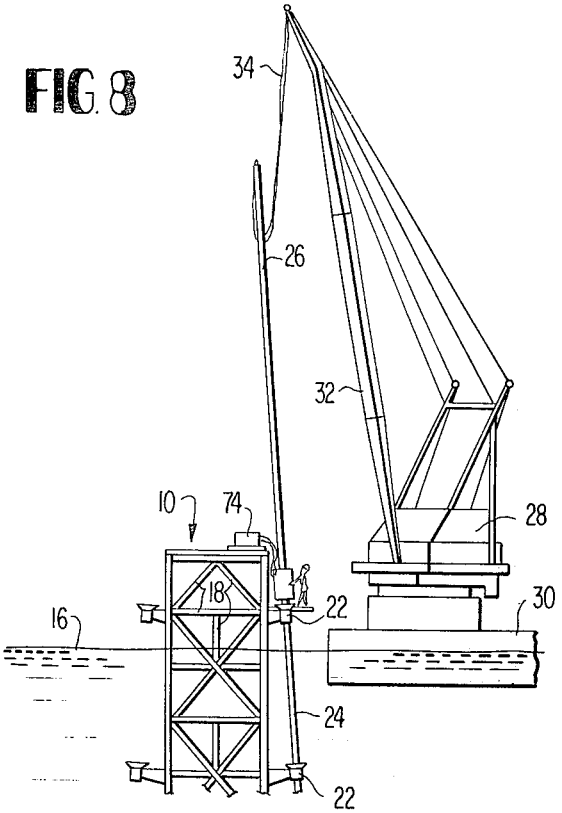
FIG. 8 illustrates schematically a side view of the offshore tower, pilings, and floating crane with the permanent connection of the pilings in progress.

The novel method of the invention is perhaps best illustrated in FIGS. 7, 8, 9, and 10. As can be appreciated from these FIGURES, as well as FIGS. 3 and 4, the gripper 44 is carried by and surrounds a portion of the length of the add-on piling 26. The add-on piling and gripper are lowered into engagement with the suspended piling 24 as illustrated in FIG. 7. Next, the hoisting cables 34 of the derrick can be slackened or relaxed as illustrated in FIG. 8. If desired, the cables can be entirely disconnected.

To ensure axial alignment of pile sections 24 and 26 — and correct any "canting" of pile section 26, alignment jacks may be installed by workmen between the padeyes 56 of the guide 36 and gripper 44. With the jacks thus installed the gripper 44 may be released and the jacks contracted to pull gripper 44 telescopingly down over pile 26 until base 42 abuts the top 40 of guide 36. This engagement will cause the gripper 44 and pile 26 to become axially aligned with pile 24 and gripper 44 may then be grippingly reengaged with pile 26.

Figure 8A:
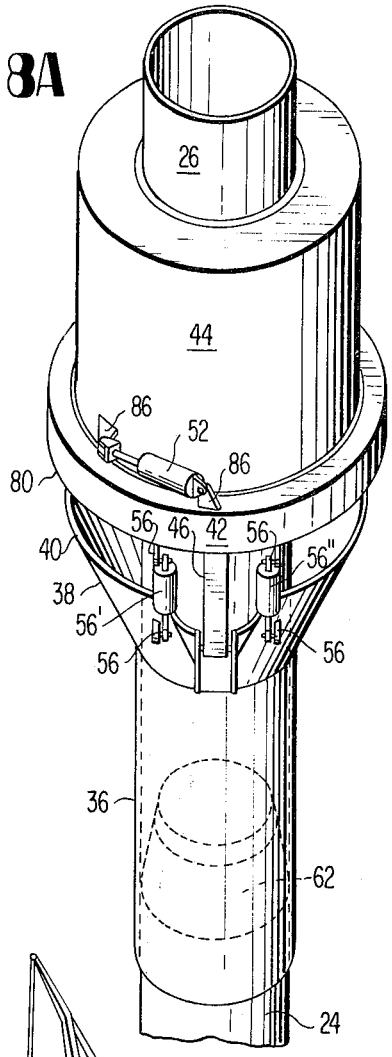
FIG. 8A illustrates an enlarged perspective view of the add-on piling and the length of piling suspended within the piling guide as the permanent connection is being made therebetween at the stage of operations illustrated schematically in FIG. 8.

The hydraulic piston and cylinder assembly 52 illustrated in FIG. 3 can at this point be activated to effect a relative rotation between the base 42 and the gripper 44 to rotate the add-on piling 26 as shown in FIGS. 8 and 8A. The relative rotation couples or connects the add-on piling 26 to the suspended piling 24 through the rotary (Rockwell) connection 54 illustrated in FIG. 4. The cables may be further slackened or perhaps even removed as the relative rotation is continued and the rotary connection completed.

As is illustrated in FIG. 9, the suspended piling can be disconnected from the piling guide or guides (as by cutting away temporary holding flanges or webs) once the add-on piling is in place. It should be emphasized, however, that the piling does not at this point fall downwardly as a result of the restraining relation existing between the base 42 of the tool and the rim 40 of the funnel 38 of the piling guide 36 and the connection 54. After the suspended piling has been disconnected from the piling guide, howeer, and it is desired to lower the piling to strata capable of supporting the piling, the hoisting cables 34 of the floating derrick may be tightened or reconnected to the add-on 26 and the entire piling lowered gradually and safely to the floor of the body of water.

The method and apparatus briefly described in the foregoing affords a number of significant advantages. It will be noted in particular that the method and apparatus affords a highly advantageous mode of connecting the initial add-on piling to a length of piling suspended from an offshore tower jacket and for thereafter handling the entire piling independently of the jacket or any floating derrick.

The Jacket

As indicated in the preceding discussion, the jacket 10 illustrated in FIGS. 1 and 2, in connection with which the method and apparatus of the present invention may be employed, involves the usual structural elements. As shown, the jacket may be comprised of vertical legs 12 interconnected and braced relative to one another by lattices comprised of suitable bracing members 18. The jacket may be constructed in a convention graving dock formed in the nearby shoreline and thereafter floated to the desired site, turned upright, and placed on the floor of the body of water. Once in position, the jacket is anchored to the floor of the body of water through the legs or other piling guides by means of heavy duty pilings. Thereafter, the superstructure can be installed to afford a completed tower.

The jacket carries at least one length of piling 24 which is to be forced into he floor of the body of water. This length of piling includes the portion that is initally forced into the floor of the body of water and is carried by the jacket to reduce problems of logistics. The predisposition of the pilings in the jacket also serves to reduce the time required to anchor the jacket to the floor of the body of water.

The jacket includes pile guiding means for supporting and guiding the length of piling as it is forced into the floor of the body of water. The pile guiding means at least partially enclose the length of piling and may be comprised of either guides within the interior of the legs 12 or individual tubular guides 20 and pile guiding collars 22 disposed on the exterior of the legs. The piling 24 is temporarily connected in the embodiment illustrated to pile guiding collars 22 and/or individual piling jackets 20 collectively referred to hereinafter as piling guides 36 (see FIGS. 3, 4, 7A, and 8A), and is thus suspended above or adjacent the mud line of the floor of the body of water. The suspended piling 24 may be connected to the piling guides by welding, or other suitable connections. Perhaps most preferably the piling is connected to the piling guides through a plurality of flanges each of which is welded to and extends radially between the piling and the piling guides. Access to these flanges can be gained through openings or windows in the respective piling guide or other access means.

The suspended piling may extend to a position above the surface 16 of the body of water as illustrated in FIG. 1, or the piling may stop short of the surface 16 as illustrated in FIG. 2. Additionally, the piling may either extend entirely to the mud line of the floor of the body of water or may stop short of the floor 14 as illustrated in either FIG. 1 or 2. In either case, the piling is considered to be suspended since the uppermost strata of the floor is too soft to support the piling. Thus, if the piling were suddenly released, the piling would fall rather suddenly until strata capable of supporting the piling was encountered. The only difference would be that in one case the piling would fall some distance prior to entering the mud.

The two pilings may be connected in any desired manner, but preferably the piling are connected together throgh the rotary connection 54 illustrated in FIG. 4. This rotary connection is preferably a conventional Rockwell, breech block assembly. As example of this type of connected is illustrated and discussed on page 3733 of the *Composite Catalogue of Oil Field Equipment and Services*, Vol. 3, 1972–1973. It must be emphasized, however, that though the Rockwell connection is preferred, other rotary connections can also be employed.

The rotary connection 54 includes a male piling stabber 62 and a female receptor 64 which are opposedly connected to the add-on piling 26 and the suspended piling 24 in a manner permitting insertion of the piling stabber 62 into the receptor 64. The stabber is inserted into the receptor preparatory to relative rotation of the two elements and the connecting together of the add-on piling 26 and the suspended piling 24.

As perhaps best illustrated in FIG. 4, the piling stabber and receptor are comprised essentially of a truncated cone 62 and conical socket 64, respectively. Disposed on the surface of the stabber and receptor are serial ridges 66. In connecting the add-on piling 26 to the suspended piling 24, the pilings must be rotationally aligned relative to one another in order to mate the ridges of the stabber and receptor as the add-on piling is lowered into place. Once the add-on is properly lowered into place, the add-on piling can be rotated relative to the suspended piling to effect the rotary connection.

It is perhaps appropriate at this point to point out certain features of the funnel 38 of the piling guide 36 illustrated in FIG. 3. The significance of these features will be explained more fully in the course of subsequent discussions. It will be noted in particular that the funnel 38 includes a slotted cup 68 formed in one portion of the funnel. The cup forms a relatively narrow slot 48 in the upper end of the pile guide. As illustrated in FIG. 4, this relatively narrow slot receives the elongated tongue 46.

The slotted character of the slotted cup 68 and the relation between the elongated tongue 46 and the relatively narrow slot 48 can be perhaps appreciated from an examination of FIG. 5. It can be appreciated that the tongue 46 is relatively closely embraced by the walls 70 of the slot 48. As will be explained in more detail hereinafter, the close relation between the tongue 46 and the walls 70 of the slot 48, serves to rotationally align the add-on piling 26 relative to the suspended piling 24. The close relation can also be used in certain instances, to assist in resisting rotational movement as the rotary connection is effected.

The piling guide also includes at least one padeye 56 disposed thereon adjacent the upper end thereof. The padeye 56 is intended to carry one end of an hydraulic piston and cylinder assembly intended to interconnect the add-on piling 26 and the piling guide 36 as illustrated in phantom in FIG. 8A. The description of the particular function of the padeyes and hydraulic piston and cylinder assembly is left for more detailed discussion to follow.

The Tool

As perhaps best illustrated in FIGS. 3 and 4 and as indicated earlier, the tool includes a releasable gripping means 44 which is connected to the base 42 and which may take the form of a jack or chuck. The releasable gripping means grips and restrains the add-on piling 26 relative to the pile guide 36 while the add-on piling is being connected to the suspended piling 24 and while the suspended piling is being disconnected from the piling guide. Preferably the releasable gripping means 44 concentrically surrounds and grips the add-on piling 26. As illustrated in FIG. 4, the end of the gripping means 44 closest to the piling guide 36 carries a planar end plate 72. The significance of this feature will become more evident in the course of subsequent discussions.

The releasable gripping means is intended to grip the length of add-on piling 26 in both horizontal and vertical directions. In other words, the add-on piling can move in neither a horizontal nor a vertical direction relative to the sleeve of the gripping means 44. Any suitable releasable gripping means can be employed so long as the add-on piling is gripped in the manner described and so long as the gripping means can be positively released upon command. However, though any suitable chuck or jack can be used, it is preferable to employ a gripping means referred to commercially as a DeLong jack.

In light of the releasable character of the gripping means, releasing means operably associated therewith must be provided to release the gripping means after the suspended piling has been disconnected from the piling guide. This releasing of the gripping means will permit the movement of the piling from the suspended position of a position in contact with supportive strata underlying the floor of the body of water. Any suitable releasing means may be employed, the particular type ultimately chosen in all likelihood depending upon the particular manner in which the gripper or jack chosen operates. As an example, if the alignment jacks are hydraulically operated, the releasing means could include an hydraulic pump and control valves which would actuate all these mechanisms. Such an arrangement is illustrated schematically in FIG. 8 and 74, with 74 comprising a pump assembly, preferably mounted on the jacket.

The tool further includes a base 42 which is intended to rest upon an upper end or rim 40 of the piling guide 36. As perhaps best appreciated from an examination of FIGS. 3, 4, and 6, the base 42 resembles a pan which surrounds the add-on 26 and a portion of the lower end of the gripper 44. As clearly illustrated in FIG. 4, the pan or base 42 is apertured at 76 to accommodate the add-on piling.

The outer periphery of the base 42 assumes a roughly C-shaped configuration and includes a generally upstanding peripheral wall 78, an annular lower bearing plate 80, and a horizontally, inwardly projecting, retaining annulus 82. It should be noted that the end plate 72 of the gripper 44 extends outwardly somewhat into the throat of the C formed by the base. It should also be noted that rollers project from the gripper into a rolling contact with the upper surface of the retaining annulus 82. These features are intended to control the movement of the gripper 44 axially of the suspended piling 24, away from the base 42. Additionally, the bearing plate 80 serves a supportive function in restraining the piling relative to the jacket through the gripper and base as a unit.

Intermediate the end plate 72 of the gipper and the bearing plate 80 of the base 42 are disposed a plurality of rolling or bearing elements 84. It should thus be appreciated that base 42 and the gripper 44 are not rigidly interconnected, but rather are capable of rotation relative to one another about an axis intended to conicide with that of the add-on piling 26. Thus, once the add-on piling is rotationally aligned with the suspended piling, the two can be rotated relative to one another to effect a rotary connection therebetween. It thus can be appreciated that the tool includes connecting means in the form of the combined gripper, base, end plate, and rolling or bearing elements capable of moving the add-on piling relative to the suspended piling and the piling guide to connect together the two pilings. It should be noted at this point that the connecting means involves solely the releasable gripping means, i.e., the gripper and the base, and is not dependent upon either the jacket or the floating derrick. The rolling means, i.e., the rolling or bearing elements 84, afford rotation of the gripper and the add-on piling as a unit relative to the suspended piling and the base resting in a stationary fashion upon the piling guide.

As can be appreciated from an examination of FIGS. 6, 7A and 8A, rotating means interconnect the gripper and the base in order to facilitate rotation of the add-on piling relative to the suspended piling. As illustrated, the rotating means includes flanges 86 disposed on the gripper 44 and the base 42. The flanges are interconnected by a hydraulic piston and cylinder assembly 52 which, as can be seen from a comparison of FIGS. 7A and 8A, can be extended to effect rotation of the gripper and the add-on piling relative to the base and the suspended piling and may be actuated by remote means 74. The direction of rotation is illustrated in FIG. 8A.

The structure and function of the rotational aligning means of the tool can be appreciated from an examination of FIGS. 3, 4, 5, 7A, and 8A. The rotational aligning means is operably associated with the base and the piling guide and serves to rotationally align the add-on piling with the supended piling. As perhaps best illustrated in FIGS. 5, 7A and 8A, the tool includes the elongated tongue 46 which extends downwardly from the lower surface of the bearing plate 80. The elongated tongue thus depending from the base is insertable through the confines of the relatively narrow slot 48 disposed in the funnel 38 of the piling guide 36, to rotationally align the two pilings. As will become clear in the course of subsequent discussion, the constraint of the elongated tongue by the walls of the slot can also assist in resisting rotational movement of the base 42 in the course of effecting the rotary connection between the pilings.

As the add-on piling is being prepared for connection with the suspended piling, the gripper 44 is clamped thereto so as to rotationally arrange the tongue 46 relative to the ridges of the receptor in a manner dependent upon the rotational relation between the piling guide and the suspended length of piling. The particular interrelation needed between the position of the gripper on the add-on piling and the position of the suspended piling within the piling guide is that needed to slip the ridges of the receptor circumferentially between the ridges of the stabber as the tongue 46 is inserted through the confines of the slot 38. If any other type of connection is employed, the principle used to effect rotational alignment should be the same. The gripper, and in particular the tongue, is secured to the add-on piling in a manner ensuring mating of the elements of the connection when the add-on piling is lowered into place. It should thus be apparent that if the gripper 44 is properly placed on the add-on 26, the tongue 46 should effect a proper rotational alignment of the add-on piling 26 relative to the suspended piling 24 as the elongated tongue 46 is inserted into the relatively narrow slot.

Concurrently, with the rotational alignment described in the foregoing and prior to rotation of the add-on piling, the add-on piling is axially aligned with the suspended piling. This axial alignment is accomplished to some degree by the relatively close, telescoping relation between the piling guide and the pilings. However, axial alignment can also be assisted through the abutting interaction of the base of the tool and the piling guide, as earlier noted. Thus the tool of the present invention affords axial aligning means comprised of the gripper surrounding and gripping the add-on piling as well as the base of the tool as it bears upon the upper end or rim 40 of the piling guide. The proper axial alignment between the add-on piling and the suspended piling is accomplished incident to the bearing contact between the bearing plate 80 and the rim 40 of the funnel 38. The bearing plate of the base is simply oriented relative to the gripper in a manner maintaining the add-on piling in axial alignment with the suspended piling while the bearing plate bears upon the rim of the piling guide.

The gripper or chuck 44 is preferably cylindrical in overall form, concentrically surrounds the add-on piling 26, and provides interior chucking elements or jaws engaging the periphery of pile 26. The lower end plate 72 of the gripper is perpendicular to the axis of the gripper and thus is perpendicular to the axis of the add-on piling. This assembly rests on the rolling or bearing elements 84 disposed between the end plate 72 and the bearing plate 80 of the base 42. Therefore the bearing plate 80 of the base 42 is also perpendicular to the axis of the add-on piling. The rim of the piling guide defines a plane which is perpendicular to the axis of the suspended piling 24. Therefore, when the base 42, through the bearing plate 80, rests on the rim 40 of the funnel 38 of the piling guide 36, the axes of the add-on piling and the suspended piling are at least parallel to one another. Because the piling guide 36 closely surrounds both the add-on piling and the suspending piling, the axes actually essentially coincide and the pilings are thereby in axial alignment.

Operationally, the axial alignment begins as the add-on piling is inserted into the piling guide and rotationally aligned. Because of the relatively close telescoping relation between the add-on piling and the piling guide, the add-on piling is roughly aligned in an axial sense. The insertion of the tongue through the slot, of course, ensures concurrent rotational alignment. Preferably at this point the base 42 of the tool is somewhat spaced apart from the rim of the piling guide. This is illustrated in FIGS. 7, 7A, 8, and 8A. The at least one piston and cylinder assembly mentioned earlier is now put in place between the padeyes 56 of guide means 36 and tool 44. Preferably a pair of these assemblies are used. The gripper is next positively released and, depending upon the resistance existing to relative movement between the gripper and the add-on piling, the tool is either slowly lowered or powered down by the jacks i.e. piston and cylinder asemblies, between the padeyes 56 so that the bearing plate 80 of the base rather tightly bears against the rim 40 of the piling guide. Because of the geometrical relation between the pilings and the tool and piling guide, the add-on piling will thus be more accurately aligned with the suspended piling, i.e. any canting of pile 26 relative to pile 24 will be corrected.

Thus, final axis alignment of the add-on piling relative to the suspended piling is assisted by the hydraulic piston and cylinder assemblies which interconnect the tool and the piling guide. It is preferable that at least a pair of hydraulic piston and cylinder assemblies i.e. assemblies 56' and 56'' shown in FIG. 7A interconnect a number of matching padeyes so as to extend from the base of the tool to the piling guide. This interconnection affords a stabilizing means for rigidly but adjustably interconnecting the tool and the piling guide so as to restrain the tool and add-on against movement axially of the suspended piling and exert axial alignment maintaining force on the add-on piling. The hydraulic piston and cylinder assemblies or jack means should assist in preventing the toppling of the add-on piling from atop the suspended piling. Perhaps more importantly, the jack means by exerting transverse force on piling 26 via the offset nature of the force means 56', 56'', can also assist in aligning the add-on piling relative to the suspended piling. For this reason, the jacks should be located on the "top" side of a sloping pile assembly, as shown, to offset canting forces, due to pile inclination, urging the add-on pile to slope or "cant" further downward.

It should at this point be appreciated that the tool of the present invention is unitary and is structurally independent of the jacket or any derrick employed to manipulate the add-on piling. There is not structural interdependence between the jacket and the floating derrick.

Aspects of and Variations in the Method of the Invention

The method of the present invention entails the handling of piling and the anchoring of an offshore tower jacket to the floor of a body of water. A length of add-on piling is connected to a length of piling temporarily connected to and suspended at least partially within a piling guide in turn connected to the jacket. As illustrated in FIGS. 1 and 2, the add-on piling 26 can be connected to the suspended piling 24 in either an above-water environment (see FIG. 1) or in a submerged environment (see FIG. 2). In either case, the operation is the same essentially, the only difference residing in the possible need for divers or certain accessories to facilitate the steps of the method and to eliminate inconveniences associated with the placement of the piling in a submerged environment.

It is important that the connection between the add-on and suspended pilings be rigid and permanent. To this end the preferred Rockwell breech block connector can be positively locked against rotation. To be sure the selected rotary joint is completely locked or fastened, the add-on piling, and thus the gripper, must be rotated to an extent sufficient to ensure locking. This may require a degree of rotary overrun in response to movement of the piston and cylinder assemblies 52. However, if the connection becomes locked before the piston and cylinder assemblies are fully extended, the assemblies may be damaged. Thus, the tongue 46 is fabricated so that it can be retracted or rotated out of the slot to free the base 42 for rotation relative to the piling guide. Thus, once the joint is locked, the piston and cylinder assemblies can continue to expand with the base of the tool slipping relative to the piling guide.

The piling may be lowered into position, preparatory to pile driving, once it has been disconnected from the jacket. Before the piling can be lowered to the floor of the body of water, however, it will be necessary to tighten or reconnect the hoisting cables of the floating derrick. Once the hoisting cables have been retensioned or connected, the tension therein may be exerted to restrain the piling as the gripper 44 is released through operation of the remote releasing means 74 illustrated in FIG. 8, which may be hydraulic in nature. The pilings should thereafter be slowly lowered to avoid the possibility of damage due to the enormous weight of the piling. Alternately, a gripper capable of slowly lowering the piling to the floor independently of the hoisting cables may be employed. As the piling is being lowered, the operation should appear as illustrated in FIG. 10. After the piling has reached strata capable of supporting the piling, the piling can be forced, by conventional pile driving, into the underlying strata to anchor the jacket in place. It should be understood, however, that the tool should be removed first. The piling can be forced into place using a hammer or vibratory driver, or any other suitable pile driving arrangement.

It can be appreciated, at this point, that throughout the entire operation the floating derrick has been effectively isolated from impact loads which might be imparted thereto incident to the anchoring of the jacket. The derrick has been isolated from the piling for minimally the time required for the rigid connection between the add-on piling and the suspended piling such that wave induced forces acting on the derrick vessel may be isolated from the piling while alignment and joining are being effected.

SUMMARY OF THE MAJOR ADVANTAGES OF THE INVENTION

It will be appreciated that in providing a method and apparatus for handling piling and anchoring an offshore tower according to the invention certain significant advantages are obtained.

A principal advantage of the invention resides in the fact that an initial add-on may be connected to a length of piling suspended from an offshore tower jacket and the piling thereafter handled independently of the jacket or any associated floating derrick.

Another advantage of the invention is afforded because the floating derrick used to manipulate piling can be isolated from impact loadings which may be imposed incident to the operation of anchoring an offshore tower jacket to the floor of a body of water.

Still another advantage of the invention occurs since the floating derrick can be essentially disconnected from the piling of a jacket prior to the time the piling is disconnected from the associated piling guides so that impact loading of the floating derrick due to wave action in the vicinity of the jacket can be avoided.

Yet still another advantage of the invention is derived from the fact that the piling can be restrained once the piling is disconnected from the associated piling guide so that the floating derrick can be employed for the purpose of lowering the piling gradually to the floor of the body of water without impact loading of the derrick.

A further advantage of the invention resides in the fact that the accurate alignment of an add-on piling with a length of piling suspended from the offshore tower jacket is essentially automated.

Still a further advantage of the invention is afforded because the axial alignment of the add-on piling relative to the length of piling suspended from the jacket is essentially automated.

Yet still a further advantage of the invention occurs since the accurate rotational alignment of an add-on piling relative to the length of piling suspended from the offshore tower jacket is essentially automated.

Another advantage of the invention is derived from the fact that the connection between the add-on piling and the length of piling suspended from the offshore tower jacket is essentially automated.

Still another advantage of the invention resides in the fact that an essentially automated rotary connection between the add-on piling and the length of piling suspended from the jacket is effected.

Yet still another advantage of the invention is afforded because the add-on piling is rigidly but adjustably connected to the length of piling suspended from the jacket preparatory to and during actual connection.

In describing the invention, reference has been made to a preferred embodiment. However, those skilled in the art and familiar with the disclosure of the invention may recognize additions, deletions, substitutions, or other modifications which would fall within the purview of the invention as defined in the claims.

What is claimed is:

1. A unitary tool for handling piling and facilitating the anchoring of an offshore tower jacket to the floor of a body of water, said offshore tower jacket comprising:

a length of piling;

pile guiding means for supporting said length of piling, the pile guiding means at least partially enclosing said length of piling, and said length of piling being connected to and disposed within said pile guiding means;

said tool comprising:

a base operable to rest upon an upper end of said pile guiding means;

releasable gripping means connected to said base, said releasable gripping means including means for gripping an add-on piling;

said length of piling and said add-on piling having matable connection means;

connecting means connected with said base and operable to effect interconnection of said length of piling and said add-on piling releasing means operably associated with said gripping means, said releasing means including means for releasing said gripping means;

said tool being operable to be wholly suspended from said add-on piling by said gripping means while said add-on piling is being lowered toward matable engagement with said length of piling;

said tool being operable to support said interconnected add-on piling and length of piling through said gripping means while said tool is supported on said end of said pile guiding means by said base resting thereon; and said releasing means, when released, being operable to permit said interconnected add-on piling and length of piling to be lowered through said pile guiding means subsequent to disconnection of said length of piling from said pole guiding means.

2. The unitary tool as defined in claim 1 further comprising:

axial aligning means, operable to axially align said add-on piling with said length of piling by exerting axial aligning force on said add-on policy.

3. The unitary tool as defined in claim 2 wherein said axial aligning means comprises:

a chuck included in said releasable gripping means, said chuck being longitudinally apertured to receive, surround, and grip at least a portion of the add-on piling;

a bearing surface included in said base and operable to bear upon the upper end of the pile guiding means, said bearing surface being oriented relative to said chuck in a manner operable to maintain the add-on piling in axial alignment with the suspended piling when said bearing surface bears upon said upper end of said pile guiding means; and stabilizing means operable to force said bearing surface against said pile guiding means.

4. The unitary tool as defined in claim 3:

wherein said pile guiding means includes first padeye means adjacent the upper end of said pile guiding means;

wherein said stabilizing means includes second padeye means extending from said base, and an hydraulic piston and cylinder assembly interconnecting said first and second padeye means and operable to draw said base against said upper end of said pile guiding means.

5. The unitary tool as defined in claim 4 further comprising:

rotational aligning means operable to rotationally align said add-on piling with said length of piling.

6. A method of handling piling and anchoring an offshore tower jacket to the floor of a body of water wherein an add-on piling is connected to a length of piling connected to the interior of piling guide means included in said jacket, said method comprising the steps of:

at least partially enclosing the add-on piling within a chuck releasably gripping the add-on piling;

hanging said add-on piling, with the chuck connected thereto, from the boom of a floating derrick;

connecting the add-on piling to said length of piling;

disconnecting the length of piling from the piling guide while said chuck is supported by said piling guide means and in turn supports said connected add-on piling and said length of piling;

releasing said chuck from said add-on piling and lowering said connected add-on piling and length of piling through said pile guiding means.

7. The method defined in claim 6 wherein said step of connecting said add-on piling to said length of piling is comprised of the further step of:

rotationally aligning said add-on piling with said length of piling; and effecting relative rotation between said add-on piling and said length of piling to effect their interconnection.

8. The method defined in claim 7 wherein said step of connecting the add-on piling to the suspended piling is comprised of the further step of:

axially aligning said add-on piling with said length of piling;

said step of axially aligned said add-on piling being effected by moving said chuck downwardly against the upper end of said piling guide means and into coaxial alignment with said length of piling, with said chuck constraining said add-on piling and causing said add-on piling to become coaxially aligned with said length of piling.

9. A method of handling piling and anchoring an offshore tower jacket comprising the steps of:

suspending a gripping chuck from gripping add-on piling;

lowering said add-on piling into said chuck suspended thereon into a position where said gripping chuck is engaged with and supported by said jacket;

connecting said add-on piling to a length of piling connected to and disposed within said jacket;

releasing said length of piling from connection with said jacket while supporting said connected add-on piling and length of piling through said engagement between said gripping chuck and jacket;

applying a restraining force to said connected add-on piling and length of piling, independent of said gripping chuck, from derrick means;

releasing said gripping chuck from gripping engagement with the add-on piling; and lowering said connected add-on piling and length of piling through said jacket.

10. Apparatus for handling piling and anchoring an offshore tower jacket, said apparatus comprising:

a gripping chuck;

means for suspending said gripping chuck from an add-on piling;

means for lowering said add-on piling with said chuck suspended thereon into a position where said gripping chuck is engaged with and supported by said jacket;

means for connecting said add-on piling to a length of piling connected to and disposed with said jacket;

said gripping means being operable to support said connected add-on piling and length of piling through said engagement between said gripping chuck and said jacket while said length of piling is released from connection with said jacket;

means independent of said gripping chuck and operable from derrick means for applying a restraining force to said connected add-on piling and said length of piling; and means for releasing said gripping chuck from gripping engagement with said add-on piling to permit said connected add-on piling and length of piling to be lowered through said jacket.

* * * * *